US005167520A

United States Patent [19]

Henry et al.

[11] Patent Number: 5,167,520

[45] Date of Patent: Dec. 1, 1992

[54] CUP FIT PLUG CONNECTOR

[75] Inventors: Randall R. Henry, Harrisburg; Michael J. Phillips, Camp Hill, both of Pa.

[73] Assignee: AMP Incorporated, Harrisburg, Pa.

[21] Appl. No.: 781,031

[22] Filed: Oct. 18, 1991

[51] Int. Cl.[5] ..... H01R 11/22

[52] U.S. Cl. ..... 439/266; 439/578; 439/248

[58] Field of Search ..... 439/578–585, 439/675, 246, 247, 248, 266

[56] References Cited

U.S. PATENT DOCUMENTS 3,094,364 7/1960 Lingg ..... 339/64
3,103,548 9/1963 Concelman ..... 439/585
3,171,707 3/1965 Powell ..... 439/583
3,296,363 1/1967 Laudig et al. ..... 439/585
4,096,627 6/1978 Forney, Jr. et al. ..... 29/628
4,165,911 8/1979 Laudig ..... 339/89 C
4,580,862 4/1986 Johnson ..... 439/248
4,697,859 10/1987 Fisher, Jr. ..... 439/248
4,734,050 3/1988 Negre et al. ..... 439/578
4,938,707 7/1990 Guimond et al. ..... 439/578

*Primary Examiner*—David L. Pirlot

[57] ABSTRACT

A coaxial electrical connector (1) comprises a multiple-sectioned, one piece shell of a coupling body (2) having a larger outside diameter cup-shaped front section (5) with outwardly flared annular lip (8), and a second intermediate sleeve form section (6) of a smaller outside diameter than the diameter of the front section (5).

6 Claims, 5 Drawing Sheets

CUP FIT PLUG CONNECTOR

FIELD OF THE INVENTION

The invention relates to a connector assembly for coaxial cables.

BACKGROUND OF THE INVENTION

Rotating collar lock connector assemblies are used for connecting coaxial cables. For example, Laudig, U.S. Pat. No. 4,165,911, discloses a connector that includes a first shell having a reduced cylindrical first section and an enlarged cylindrical second section provided with a lip. The first shell has a radial shoulder at the junction of the first and second sections. The connector further includes a one piece dielectric spacer having a reduced cylindrical first portion slidable along and intimately encircling the second section and impinging against the shoulder. The spacer includes an enlarged cylindrical second portion projecting outwardly of the second section. The spacer has a coaxial bore therethrough and is provided with a first counterbore in an end of the first portion and a second counterbore in an end of the second portion.

The second portion has a radial shoulder seated against the lip of the second section of the first shell.

Further included is a coupling sleeve having, at one end, a radially inwardly projecting flange freely rotatably received over the second section, and a second sleeve slidably received over and intimately encircling the second portion and being press fit over the second section. A flange radially outwardly projects on the second shell and cooperates with the flange of the sleeve to form an annular cavity with a spring washer received therewithin.

The connector further includes a coaxial cable having a center conductor protruding from an end of an encircling dielectric layer and an encircling conductive sheath. The sheath is received over the first section and is electrically connected thereto. The center conductor is connected to a elongated met contact which is slideably received in the bore and which projects outwardly into the second counterbore. The end of the dielectric layer projects through the first section and is intimately encircled by the first counterbore.

The present invention relates to a connector that may be substituted for the threaded connector in instances where a quick connect/disconnect capability is required. The present invention relates to a mating plug which provides a temporary press-fit capability to a portable phone while being operated in the portable mode by eliminating the requirement of a coupling nut such as that characterizing the Laudig connector. The present invention relates to a dual crimp connector with a special cup in the interface area which imparts the capability of blind mating with a receptacle. The cup provides for misalignment during mating and is dimensioned to prevent contact stubbing.

SUMMARY OF THE INVENTION

The present invention relates to a coaxial electrical connector comprising an outer shell coupling body having a through passageway, a one piece dielectric insert received within the passageway of the coupling body and having a through bore, and a center contact member positioned within the bore of the insert. The outer shell coupling body comprises a multiple-sectioned, one piece shell characterized by sleeve form sections. The sleeve form sections comprise a larger outside diameter cup-shaped front section with a cavity and a second intermediate sleeve form section of a smaller outside diameter than the diameter of the cavity. The cup-shaped front section has an outwardly flared annular lip. The second intermediate section has an annular shaped flange defining an annular recess between the flange and the cup-shaped front section. The sections are joined one to the other by transition sections to form an integral shell body having a continuous through passageway.

The passageway of the one piece outer shell is coextensive with the cavity of the front section and is characterized by the enlarged cylindrical cavity and the reduced cylindrical rear section forming a radial shoulder. The one piece dielectric insert is received within the outer shell intimately encircled by the reduced cylindrical rear section and impinged against the radial shoulder. The center contact member may comprise a cylindrical pin section terminating in a forward frustoconical contact section and having a rearward annular flange portion. The member has a rearward inner slot for accepting an electrical contact. The dielectric insert may be characterized by a through bore a reduced bore front section with a transition section to an enlarged bore second section. An annular shoulder is formed at the transition section and the center contact member is positioned within the bore with the rearward annular ,flange portion abutting the annular shoulder. The pin section of the contact projects from the dielectric insert into the cup of the front section of the outer shell coupling body.

DESCRIPTION OF A PREFERRED EMBODIMENT

Figure 1:
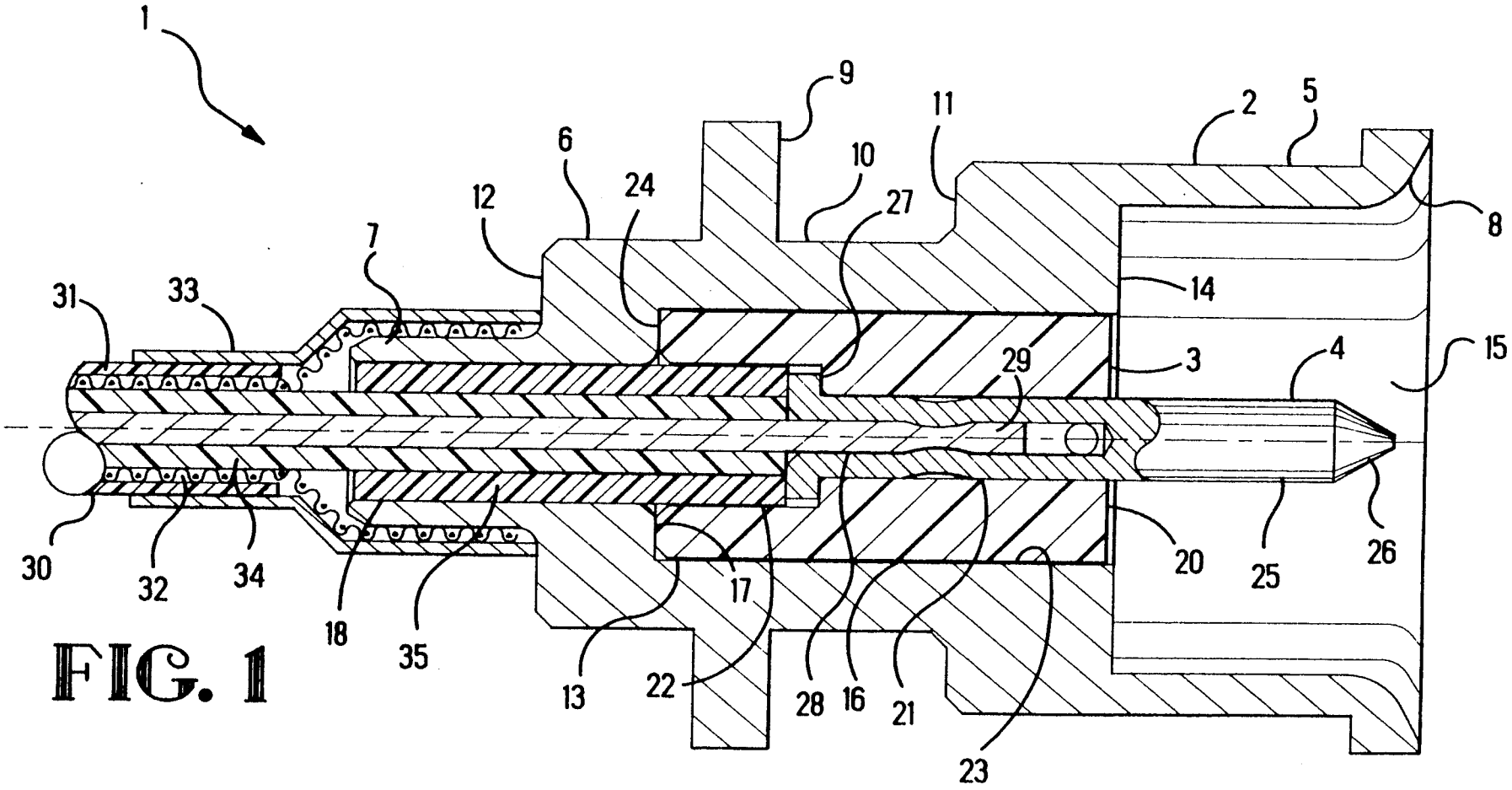
FIG. 1 is a side sectional view of the coaxial electrical connector of the present invention.
Figure 2:
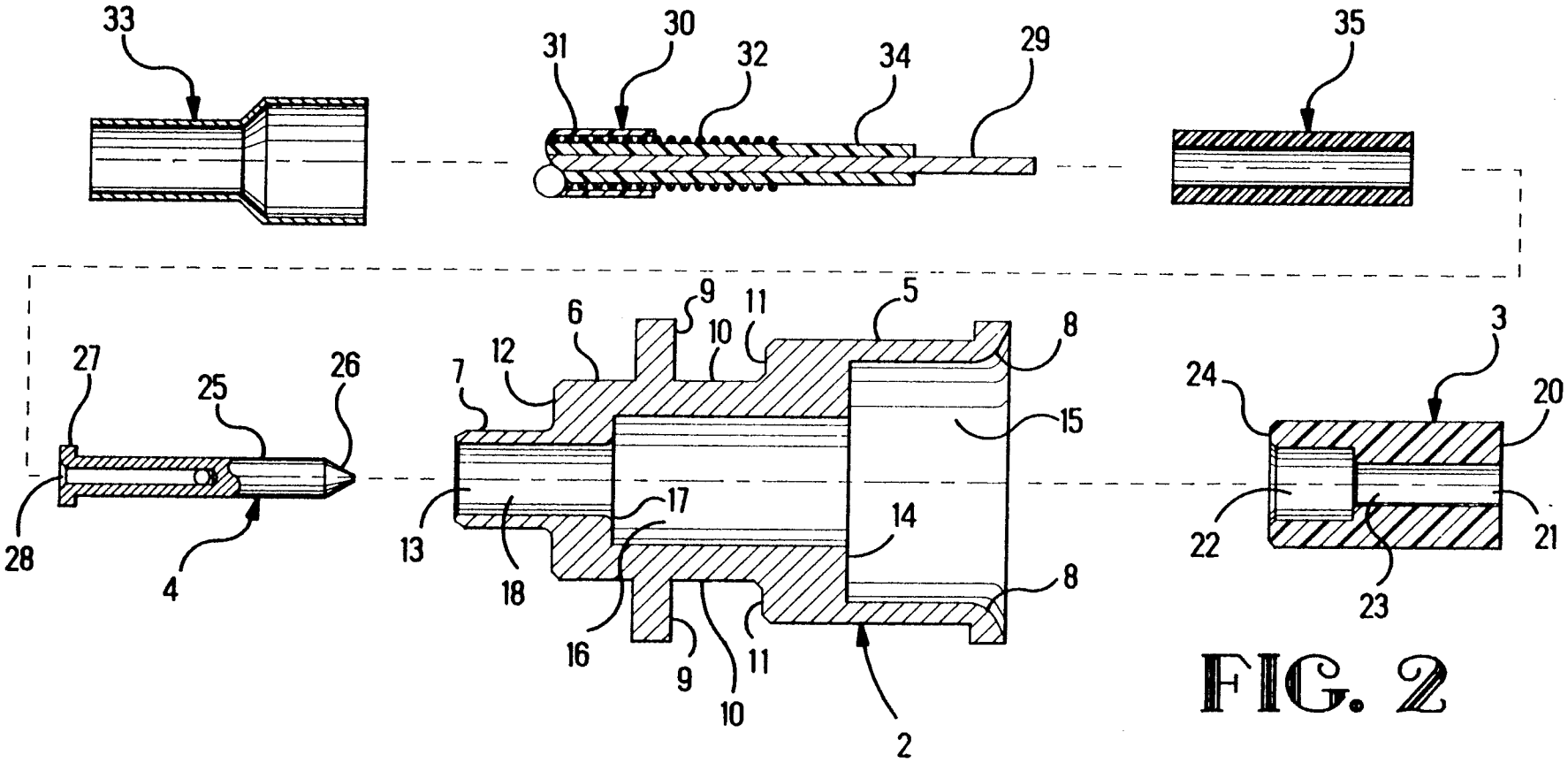
FIG. 2 is an exploded view of the sectional of FIG. 1.

With reference to FIGS. 1 through 5, shown is the coaxial electrical connector 1 of the present invention comprising an outer shell coupling body 2, a one piece dielectric insert 3, and a center contact member 4. The shell coupling body is a multiple-sectioned, one piece shell characterized by sleeve form sections 5, 6, 7. The sleeve form sections 5, 6, 7 include a larger outside diameter cup-shaped front section 5 and a second intermediate sleeve form section 6 of a smaller outside diameter than the diameter of the front section 5. The cup-shaped front section 5 has an outwardly flared annular lip 8. The second intermediate section has an annular shaped flange 9 defining an annular recess 10 between the flange 9 and the cup-shaped front section 5. The sections 5, 6 are joined one to the other by transition section 11.

The shell body 2 terminates in a rear sleeve 7 of smaller outside diameter than the diameter of the second section 6. The sleeve section 7 is joined to second section 6 by transition section 12. The three sections 5, 6 and 7 form an integral body 2 having a continuous cylindrical stepped through passageway 13. The stepped construction forms annular shoulder 14 where front cup cavity 15 transitions to next intermediate passageway 16 and annular shoulder 17 where intermediate passageway 16 transitions to a final passageway 18.

A one piece dielectric insert 3 is received within the passageway 16 until it abuts against the annular shoulder 17 concentrically surrounded by the outer shell body 2 with a front face 20 slightly recessed past the shoulder 14 of the cup shaped cavity 15. The insert 3 is cylindrical in shape with a relatively slender interior bore 21 from front face 20 expanding into bore 22 of greater diameter to form a continuous passageway 23 from front face 20 to rear face 24.

Center contact member 4 has ferrule section 25 extending from frusto-conical contact section 26 to annular flange 27. Contact member has slot 28 for receiving the center signal carrier wire 29 of a coaxial cable 30. Cable 30 is shown with its jacket 31 cut back and outer conductive braid 32 positioned around the rear end section 7 of shell coupling body 2. A crimpable sleeve 33 is crimped around the braid 32 to retain it on the shell rear end section 7 with insulative sheath 34 and center signal carrier wire 29 of the cable 30 inserted within a hollow dielectric liner 35 which serves to assure alignment is maintained and buckling is prevented while the connector 1 is mated as hereinafter described.

Figure 3B:
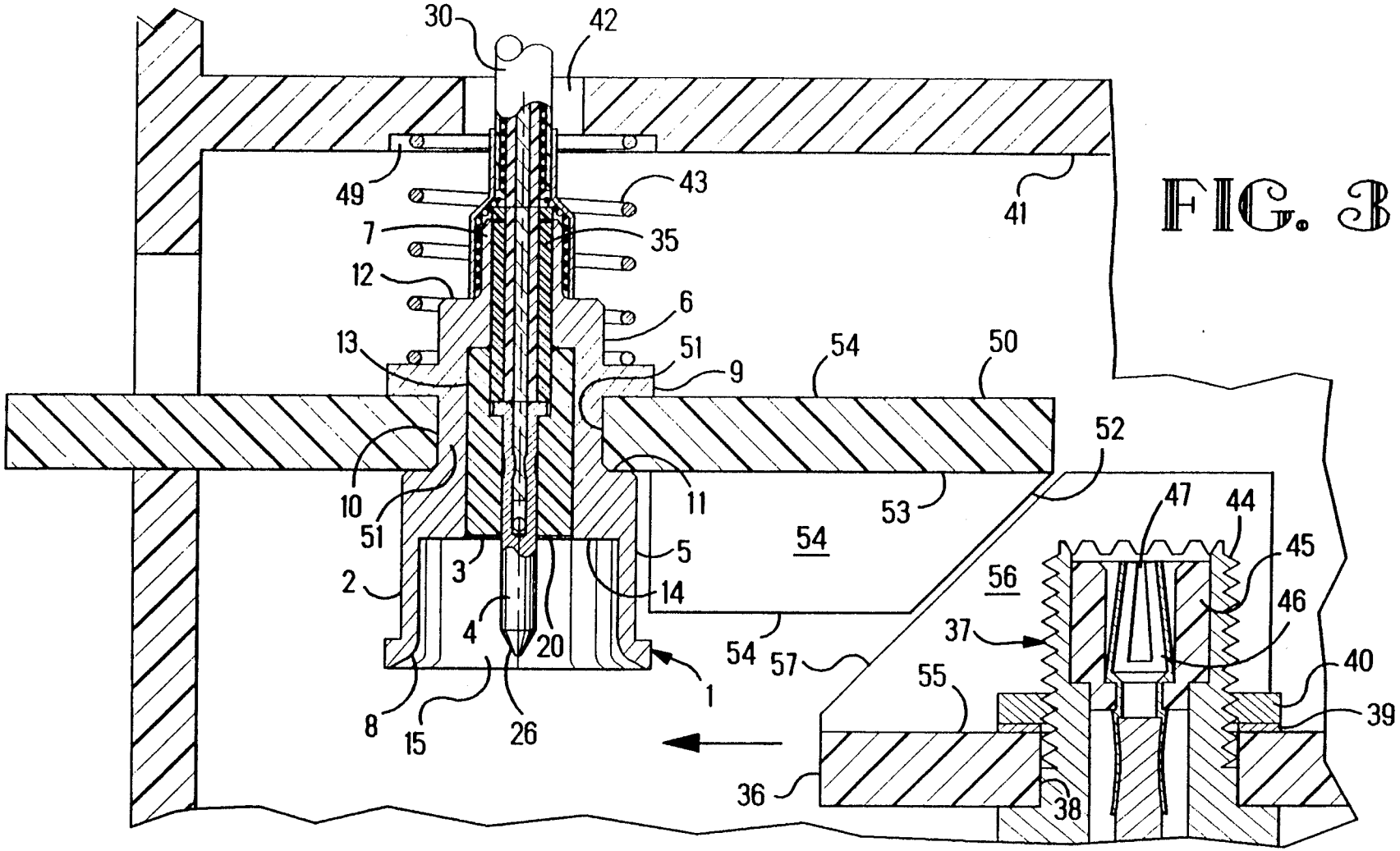
FIGS. 3, 4 and 5 are side sectional views of a panel mounted connector of the present invention during mating with a complementary connector.
Figure 4:
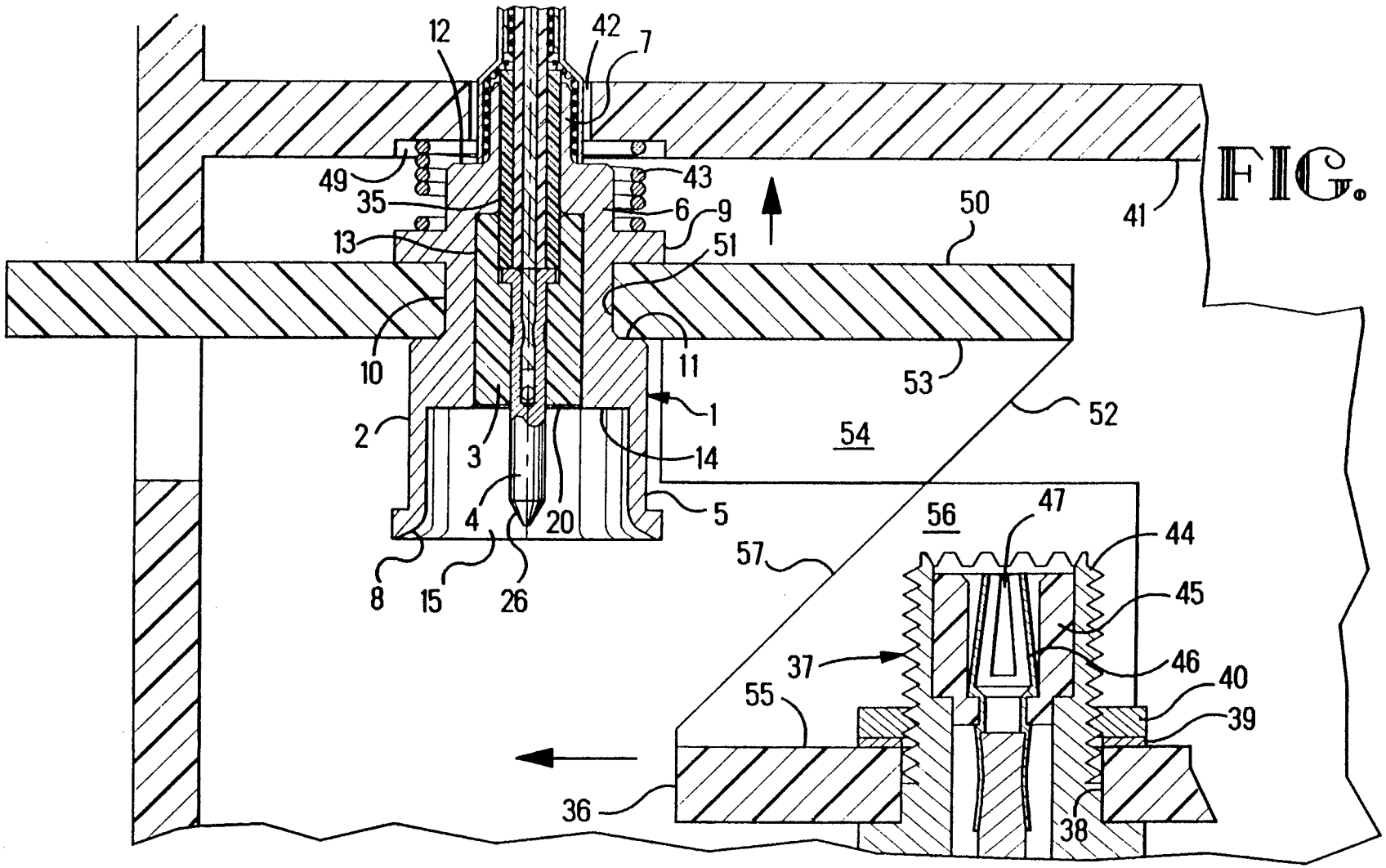
Figure 5:
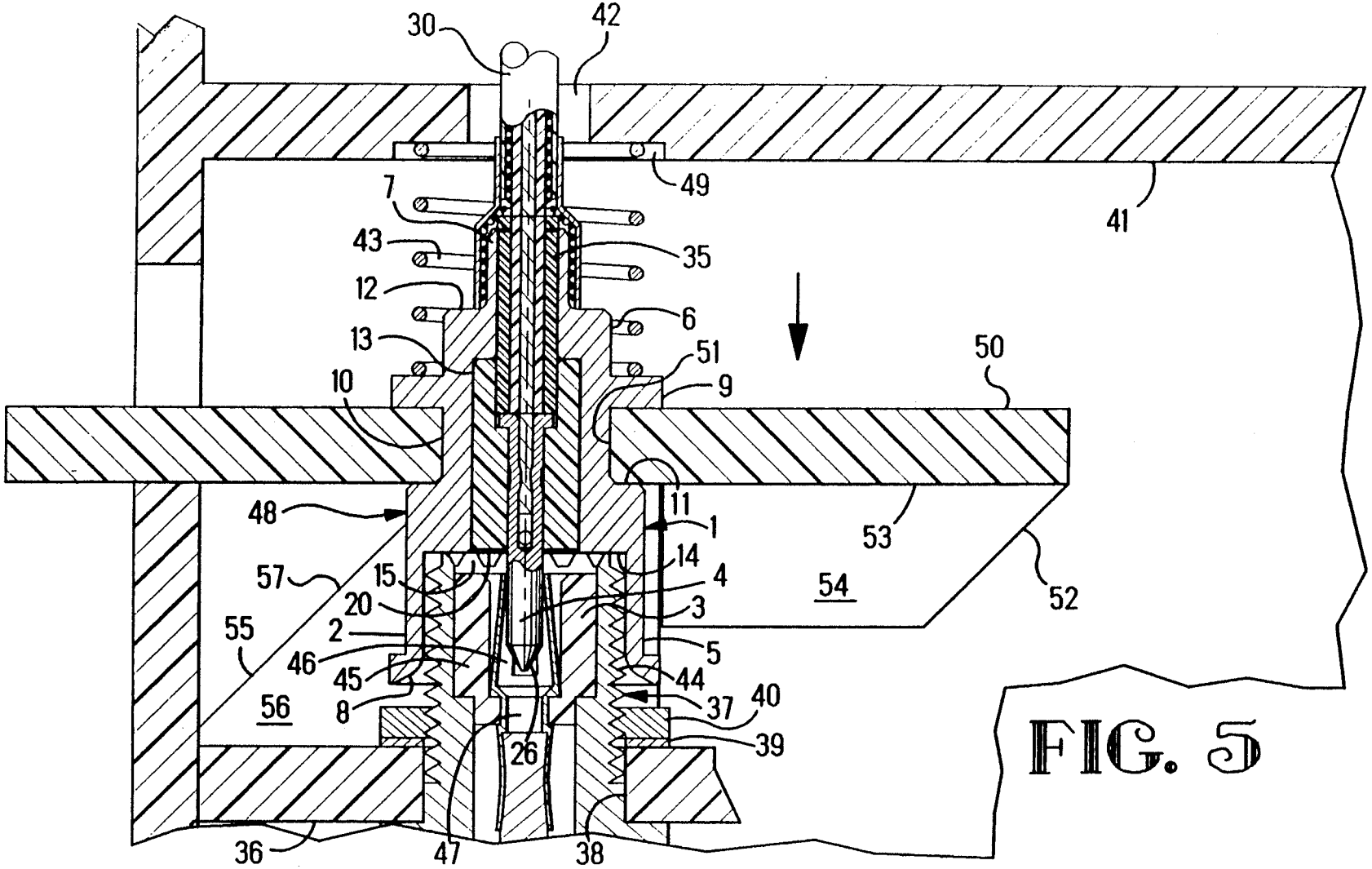

The present invention particularly relates to a connector that may be substituted for a threaded connector in instances where a quick connect/disconnect capability is required. Referring to FIGS. 3, 4 and 5, is illustrated a use of the preferred embodiment of the present invention, whereby a mating plug 1 is provided which permits a temporary press-fit capability to a portable phone while being operated in the portable mode.

A bulkhead 36 of the power pack of the phone is illustrated with complementary connector 37 secured through port 38 by means of washer 39 and nut 40. Further shown is the present connector 1 secured through the bulkhead 41 of a receptor casing with coaxial cable 30 passing through port 42. The connector 1 is biased against the bulkhead 41 by means of spring 43.

Complementary connector 37 is shown comprising a forward outer shell 44, a first dielectric body 45 concentrically surrounded by the outer shell 44, and a conductive electrical contact 46 surrounded by the dielectric body 45. The conductive electrical contact 46 has a center receptacle passageway 47. When the coaxial electrical connector 1 is mated with the complementary connector 37 to form a connector assembly 48 as shown in FIG. 5, the center contact member 4 of the coaxial electrical connector 1 is inserted within the center receptacle passageway 47 and the cavity 15 of the cup-shaped front section 5 securely retains the complementary connector forward outer shell 44.

The coaxial electrical connector 1, shown in FIGS. 3, 4 and 5, further comprises a spring means which is spring 43. The spring 43 resides within an annular indent 49 within the supporting bulkhead 41. The indent 49 is part of port 42 through which the coaxial cable 30 passes from the connector 1 to other elements, not shown. The spring 43 imposes against the annular shaped flange 9 of the front section 6 of the one piece shell 1 whereby the coaxial electrical connector 1 is biased into contact with the complementary connector 37. The coaxial electrical connector 1 further comprises a slide lock body 50 with an aperture 51. The front section 6 and the cup-shaped section 5 of the one piece shell coupling body 1 imposes through the aperture 51 with the shell 1 secured to the slide lock body 50 with a portion of the slide lock body 50 secured within the annular recess 10 defined between the flange 9 and the cup-shaped front section 5. The slide lock body 50 further includes an inclined cam surface 52. In FIGS. 3, 4 and 5, the lock body 50 is shown as including two plane surfaces, 53 and 54, intersecting perpendicular to one another. The inclined cam surface 52 is shown as part of plane surface 54.

Further with reference to FIGS. 3, 4 and 5, complementary connector 37 is secured to bulkhead 36 through port 38. Bulkhead 36 has two planes, 55 and 56, intersecting perpendicular to one another and with one plane 56 having an inclined cam surface 57 complementary to the inclined cam surface 52 of the slide lock body 50.

With to FIGS. 3, 4 and 5 in sequence, during mating, bulkhead 36, as part of a portable phone power pack, slides toward slide lock body 50 in a direction paralleling bulkhead 41 until inclined surface 52 contacts complementary inclined surface 57. As the cam surfaces, 52 and 57, meet, slide lock body 50 with connector 1 is cammed for movement against the bias of spring 43 (FIG. 3).

As the connector 1 is cammed, the forward outer shell 44 of the complementary connector 37 is axially spaced by a clearance from the lip 8 of the cup shaped section 5. The bias of spring 43 urges the connector 1 forward so that shell 44 may nestle within the cavity 15 of the cup shaped section 5. Pin contact section 26 engages in the center receptacle passageway 47 of contact 46. The flare 8 of the cup cavity 15 funnels the shell 44 to compensate for misalignment during mating. Further the cavity 15 is dimensioned to engage and surround the forward outer shell 44 of complementary connector 37 so that, insertion of shell 44 deeply into section 5 is self aligning to prevent stubbing of contacts 26 and 47 when they engage.

We claim:

1. A coaxial connector assembly, comprising: first and second electrical connectors, each being adapted with a cam surface; a bulkhead; a biasing spring between the bulkhead and the first electrical connector for biasing the first electrical connector in a first direction for contacting the second electrical connector; and at least one of the cam surfaces being movable to engage the other and cause movement of the first electrical connector in a second direction opposite to the first direction to prevent contact between the electrical connectors while the cam surfaces are engaged.

2. A coaxial connector assembly as recited in claim 1, wherein, at least one of the first and second electrical connectors are adapted for being moveable laterally relative to the other and laterally of the first direction to engage the cam surfaces.

3. A coaxial connector assembly as recited in claim 1, wherein, the cam surface of the first electrical connector extends from a slidable body moveable with the first electrical connector, and the cam surface of the second electrical connector extends along a bulkhead adapted to be moveable with the second electrical connector.

4. A coaxial connector assembly as recited in claim 1, wherein, each of the connectors are comprised of; an outer shell, a dielectric body concentrically surrounded by the outer shell, and a conductive electrical contact member surrounded by the dielectric body; the contact members being adapted for engagement with each other; and the outer shells being adapted for engagement with each other;

5. A coaxial connector assembly as recited in claim 1, wherein, at least one of the connectors is connected to a bulkhead and to a coaxial cable extending through the bulkhead.

6. A coaxial connector assembly as recited in claim 1, wherein the cam surfaces are inclined and are opposite each other.

* * * * *